US005231244A

United States Patent [19]

Clouvel et al.

[11] Patent Number: 5,231,244

[45] Date of Patent: Jul. 27, 1993

[54] OPEN BREECH WEAPON

[75] Inventors: Pierre M. A. Clouvel, Bourges; Georges H. Simon, Saint Germain, both of France

[73] Assignee: Giat Industries, France

[21] Appl. No.: 768,219

[22] PCT Filed: Feb. 14, 1991

[86] PCT No.: PCT/FR91/00120

§ 371 Date: Oct. 15, 1991

§ 102(e) Date: Oct. 15, 1991

[87] PCT Pub. No.: WO91/12479

PCT Pub. Date: Aug. 22, 1991

[30] Foreign Application Priority Data

Feb. 14, 1990 [FR] France ..... 90 01759

[51] Int. Cl.[5] ..... F41A 9/28

[52] U.S. Cl. ..... 89/33.03

[58] Field of Search ..... 89/155, 156, 157, 33.03; 42/39.5, 59

[56] References Cited

U.S. PATENT DOCUMENTS

| | | | |
|---|---|---|---|
| 467,089 | 1/1892 | Forbes | 42/39.5 |
| 2,317,579 | 4/1943 | Bacon | 42/39.5 |
| 2,970,521 | 2/1961 | Bell et al. | 89/33.03 |
| 3,446,113 | 5/1969 | Dardick | 89/155 |
| 3,782,242 | 1/1974 | Angell et al. | 89/33.03 |
| 4,123,962 | 11/1978 | Williams | 89/33.03 |

FOREIGN PATENT DOCUMENTS

| | | | |
|---|---|---|---|
| 20275 | 9/1914 | United Kingdom | 89/155 |

*Primary Examiner*—Stephen C. Bentley

*Attorney, Agent, or Firm*—Parkhurst, Wendel & Rossi

[57] ABSTRACT

Open breech weapon comprising a barrel having a rear end locked to a casing, a rotor rotatably mounted in said casing about an axis parallel to said barrel, said rotor comprising at least one peripheral cavity which extends parallel to the rotation axis of the rotor, control means for driving in rotation said rotor the cavity of which, during one rotation of the rotor, comes successively into opposition with a feeding position to receive an ammunition round from a feeding device, with a firing position where said cavity is coaxial with said barrel to fire the ammunition by action of a firing pin, and with an ejecting position to eject the shell of the last fired ammunition round through an ejection device. At least two arcuate segments are located between said casing and said rotor, each segment being hinged to said rotor to have an oscillating motion with respect to said rotor, and being provided with a longitudinal cavity at each end which is parallel to said cavity of said rotor, and locking-unlocking means for moving said segments in a closed position when the cavity of said rotor is in the firing position, said cavity and the cavities of said segments forming a breech of the same shape as the ammunition to be fired.

8 Claims, 9 Drawing Sheets

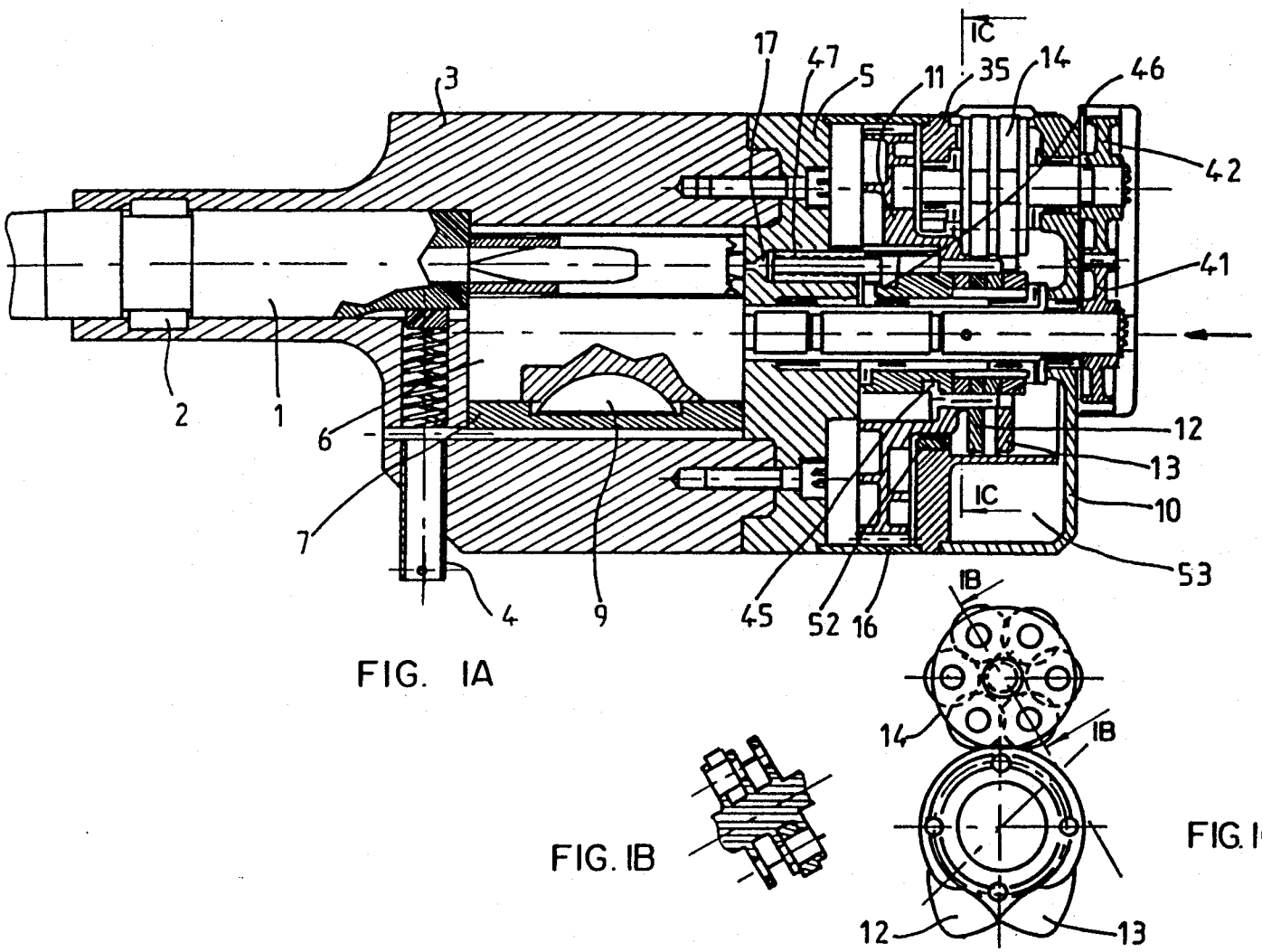
FIG. IA
FIG. IB
FIG. IC 2B
2C
2D
3
5
6
7
8
9
9a
15
18
19
20
21
22
23
24
25
26
27
28
29
30
32
33
37
38
39
43
44
48

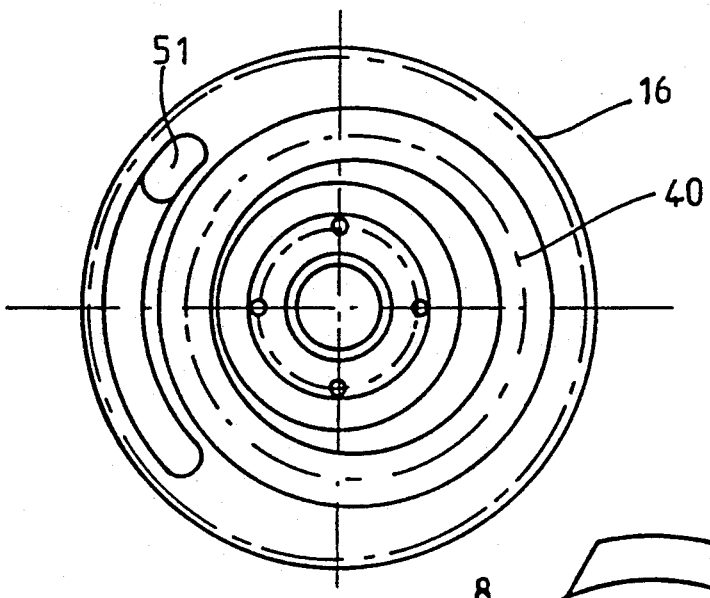
FIG. 7
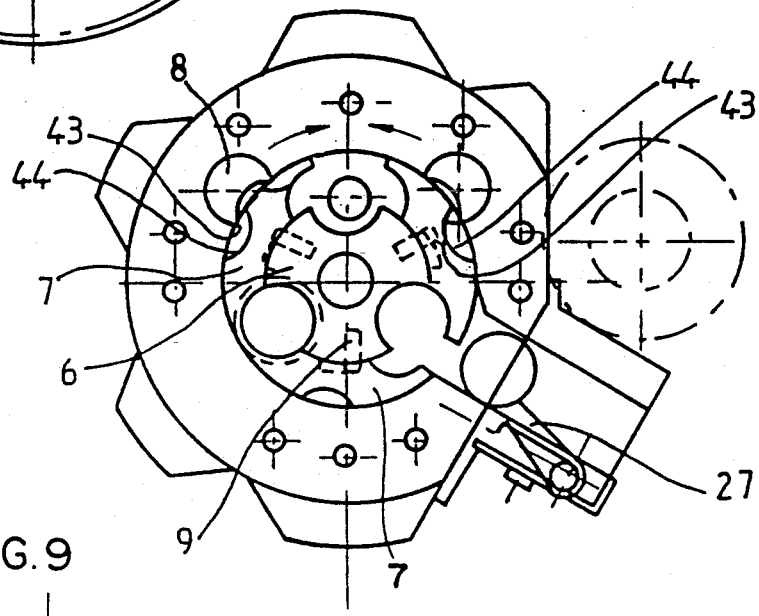
FIG. 8
FIG. 9
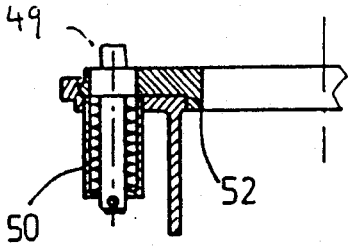
FIG. 10
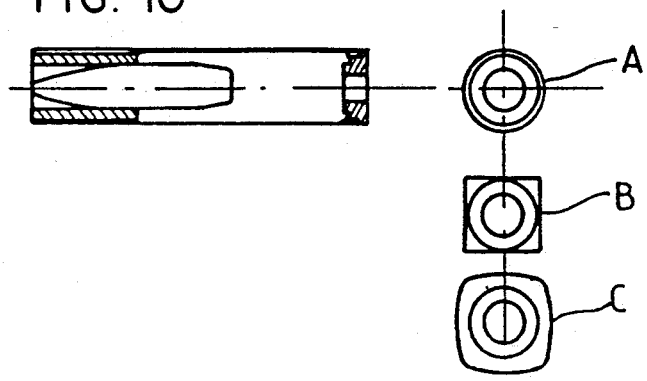

FIG. 13A
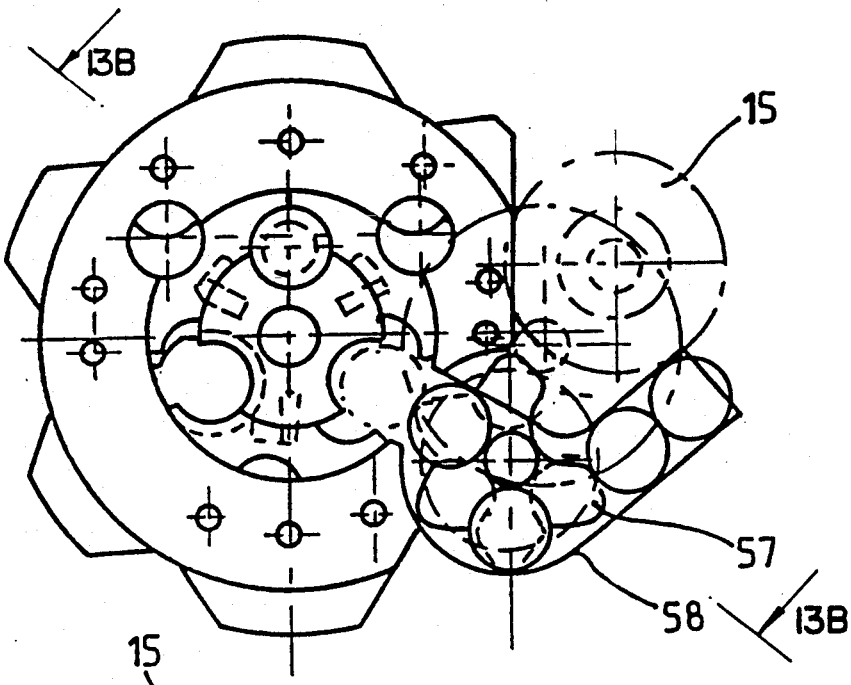
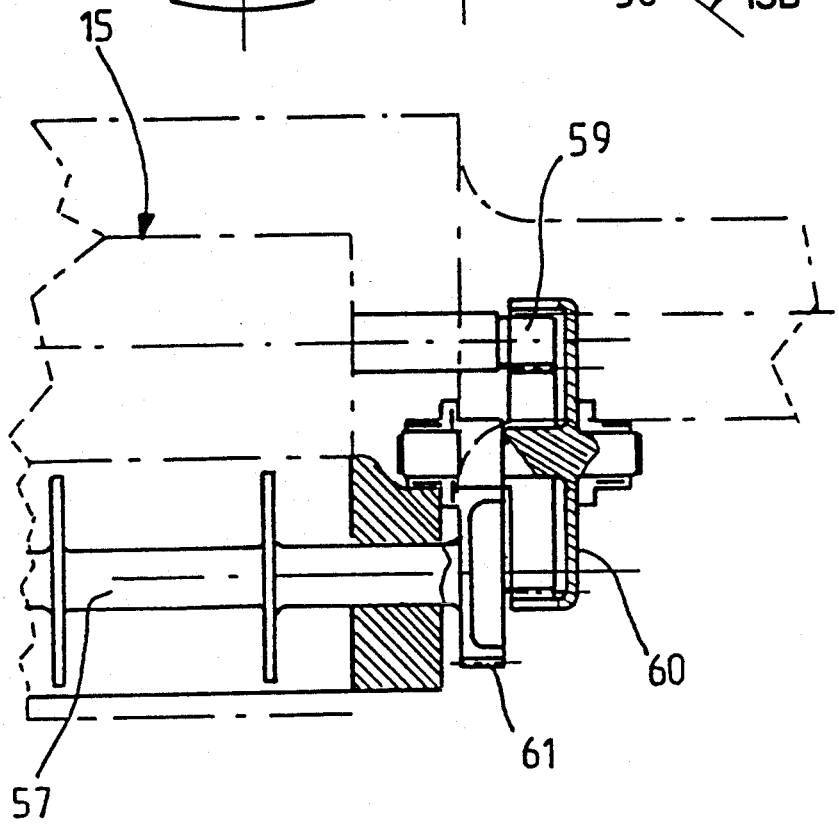
FIG. 13B 16C
16E
16F
15
27
28
29
30
32
33
38
39
50
52
63
64
65
66
67
68
70
71
73
74
75
78
81

OPEN BREECH WEAPON

BACKGROUND OF THE INVENTION

1. Field of the Invention

The present invention concerns an open breech weapon.

The field to which the present invention applies is that of small and medium calibre automatic weapon systems; more specifically open breech weapons intended for the firing of telescoped ammunition.

2. Related Art

In a conventional automatic weapon, the rounds to be fired must be inserted into a breech longitudinally. This process is effected by means of mechanisms displaced by high amplitude alternative translation movements. The insertion travel is greater than or equal to the length of the ammunition. This configuration gives rise to significant translation speeds and acceleration which significantly limit the firing rate. As the breech of this type of weapon always consists of a bored hole manufactured inside a single-piece component, there is no other alternative but for ammunition to be inserted longitudinally.

An open breech consists of at least two parts which move with respect to each other and the assembly of which forms a cavity of the same shape as the round to be fired. Generally open breech weapons have a cylindrical rotor which has one or more grooves parallel to its axis at its edge, the shape of which is the same as that of a round. This rotor rotates inside a race which has lateral openings such that the ammunition can be fed and that empty shells can be ejected. Closure of the breech with respect to the firing location is provided by the race or by a moving part. The rounds fired in this type of weapon are almost always triangular in section and have curved sides and the radius of the curve on the sides is equal to the radius of the rotor. This design enables lateral feeding of the rounds. Low amplitude translation movements result, thus giving the possibility of much faster firing rates.

Other significant advantages result

- shorter and more compact weapons than classical weapons;
- basically rotary movements which are easy to obtain using an external power source,
- the possibility of firing telescoped-type ammunition, thus exploiting the volume/useful weight ratio to a maximum, which is a particularly useful feature for the integration of the weapon into an aircraft, for example, when it is known that the aircraft carrying capacity is limited and precisely defined.

Moreover, telescoped ammunition offers excellent projectile protection against outside attack and also, more importantly, from impacts. It is thus well suited to pointed ammunition and under-calibrated ammunition while dispensing with the requirement for protective caps. Conversely, as a result of the swelling of the shell after firing and the friction therefrom, the rotation of the rotor becomes difficult and absorbs a lot of energy. This problem has been approached in various ways.

The French patent 164601 published under number FR1603956 proposes a mechanism for ammunition without shells which is driven in an oscillating movement and can fire either telescoped rounds or classical no-shell rounds. The seal against combustion gases is provided by means of one or more intermediate parts in conjunction with the smooth rotor surfaces and uses the pressure developed by the gases in some configurations.

The following problems in this system are present: a seal with parts which are not locked in firing position as the system's basis, said position thus possibly being unfixed and sensitive to contamination, especially in the version used with classical ammunition designs. This fault prohibits the use of such a weapon, for example, on board an aircraft, where a large number of no-shell rounds could be located in the immediate proximity of the casing and thus of any propellant gas leaks. An explosion risk would thus result.

The patents published under numbers FR1159282, FR1604264 and U.S. Pat. No. 2,847,784 all concern telescoped ammunition with triangular shell shapes intended to reduce friction caused by to the swelling of the shell after firing. The patent published under number FR1159282 describes a weapon consisting of a rigid casing frame in which a rotating cylindrical rotor with machined cavities of the same shape as the shell is disposed. Between the frame and the rotor, there is a moving part with a cylindrical side facing the rotor. This side has the same radius as the rotor; the opposite surface is in contact with the frame in the form of a slip surface which slopes with respect to the first side. This part is subjected to the action of a spring which jams it between the rotor and the frame in such a way that the mechanism-casing closes. Once the round is fired, the shell is flattened against the moving part and transfers the rotor's movement to it.

As the thickness of the moving part decreases, the shell can continue to dilate until a gap appears between the moving part and the frame. At this point, friction is negligible as the shell is no longer exerting any pressure. When the rotor rotates sufficiently, because the shell is no longer in contact with the moving part, the latter returns to its position in contact with the rotor and closes the breech. This solution does not appear to fully respond to the problem as it arises. In fact, there is still a rotor "unsticking" phase immediately after firing which requires significant force after jamming of the moving part by the dilated shell. Moreover, if the firing rate is high and thus sequence times of the order of a few milliseconds are required, it is difficult to ensure by means of a simple return spring that the moving part will return to position. In such conditions also, recoil phenomena can also be feared and would make the location of the moving part uncertain during firing.

The patent published under number FR1604264 concerns a weapon of the same design as that just described. The solution to the friction problems consists in creating a "skin" on the surface of the frame opposite the shell, and sealing against propellant gas is effected by the shell itself. It thus follows that this device allows significant play to remain. Indeed, play of several tenths of a millimetre between the rotor and breech, which in turn results in (this point is mentioned in the patent's own description) the shell possibly ripping or becoming extruded and thus destroying the seal and safety of the system. In this case too, a significant "unsticking" force has to be overcome after firing.

The U.S. Pat. No. 2,847,784 describes a weapon, the frame and rotor of which are each executed in two parts sleeved one into the other and the internal part of which has dimensions slightly greater than those of its seating in the external part. Sleeving is effected either by heating and dilation of the female part or by cooling and contraction of the male part, or by joint use of both techniques. This execution method results in antagonistic forces against those induced by shell swelling after firing, thus preventing mechanism-casing material from becoming plastic. It is hoped that dilation of the shell will not exceed the elasticity limit of the material of which it is made, thus solving the friction problems.

Without wishing to pre-judge the validity of such a design, it seems less than realistic: the recommended manufacturing method results in significant dispersion which is difficult to quantify where the intesity of stresses and resulting forces are concerned. Further, the same uncertainty concerning the reaction capability of the device is present where shell dilation is concerned.

One of the characteristics common to all the above-discussed prior devices is that they are all limited to triangular-shaped ammunition which is difficult to grasp and which result in the risk of causing storage and feed difficulties.

The origin of the choice of triangular ammunition lies on the one hand in the ease with which it can be positioned with respect to the breech, thus enabling "bulk" feed to occur and on the other, the possibility of using shell dilation after firing in effecting a seal.

Conversely, this choice brings with it the fact that, in the case of automatic feed, feed occurs slowly in order not to subject the ammunition to shocks which are too great. As a result, for a single-barrel weapon, a limited firing rate only can be achieved, which is not high enough for the requirements of modern combat. Unless an external motor weapon of Gattling type were designed (U.S. Pat. No. 3,041,939), in which there are as many breeches as there are barrels, which eradicates breech/barrel positioning problems but results in a heavy and ungainly weapon, the moving part inertia of which does not permit of rapid-fire rates. Such a design strays from the aims intended to be achieved by the design of open breech weapons.

The achievement of high firing rates compels one to have recourse to complex feeder mechanisms which are probably heavy, costly and unreliable as a result (patents published under numbers FR1603954 and FR2006285). Moreover, the choice of a seal based on shell dilation, as well as the jamming problems resulting from permanent deformation of the said shell and absorption of energy, both as mentioned above, results in the risk of rips occurring at corners, resulting in leaks, which renders this design unreliable. Therefore, the patent published under number FR 1603739 provides for shell corner strengthening. Finally, a shell of triangular section has a disadvantageous powder volume/-weight ratio when compared with a round of cylindrical or square section.

SUMMARY OF THE INVENTION

In order to circumvent the disadvantages of the state of the art, the weapon in accordance with this invention proposes a solution at two levels.

Firstly, an operationally reliable open breech weapon with a high firing rate has been designed using the following combination:

motor,
control component,
rotor rotary motion drive device,
ammunition feeder,
detonation device,
ejection device.

Secondly, a device which makes the breech rigid and limits deformation of the shell, while at the same time making it easy to extract, has been designed. This device can be integrated in the preceding weapon and can be adapted to any type of ammunition.

The invention mainly concerns an open breech weapon which has a rotor to feed the rounds to firing location, characterised in that it comprises features which form a breech surrounding the round during the firing phase features which lock the breech during the firing phase, and features which unlock the breech after the firing phase to facilitate shell extraction, even if it has undergone dilation during and/or after firing. The invention concerns a weapon characterised in that the breech comprises on the one hand a rotor cavity and on the other two cavities belonging to two components connected to the rotor, said components being able to undergo limited rotary displacement with respect to the rotor.

The invention concerns a weapon characterised in that it comprises a cam driven by a motor designed to guide and synchronise the displacement required for the weapon to operate, the cam effecting one complete revolution per round fired.

The invention concerns a weapon characterised in that the cam comprises a guide-groove, some portions of which prevent unlocking of the breech during the firing phase. The invention concerns a weapon characterised in that the breech is circular in section.

The invention concerns a weapon characterised in that the breech has a square section. The invention concerns a weapon characterised in that it comprises an incline in the ammunition feeder mechanism which separates the ammunition and thus facilitates the rounds being grasped by a loader mechanism. The invention concerns a weapon characterised in that the rotor comprises three cavities enabling the following simultaneous events to occur:

grasp rounds for the subsequent shot,
define a breech for firing,
remove an empty shell from the prior shot.

The invention concerns a weapon characterised in that the weapon is a machine gun intended to fire telescoped ammunition.

The invention pertains to a projectile firing process characterised in that it comprises the following stages:

grasping of a round,
rotation of the round to effect its positioning opposite the barrel,
formation of a breech around the round,
locking of the breech,
detonation of the round,
unlocking of the breech,
rotation of the shell to be located opposite an ejection aperture,
shell ejection.

BRIEF DESCRIPTION OF THE DRAWINGS

The invention shall be better understood using the following description and the appended drawings, given as non-exhaustive examples, amongst which:

FIG. 1A is a partial sectional view of open breech weapon in accordance with a first embodiment of the invention for firing cylindrical ammunition.

FIG. 1B is a partial sectional view along line 1B—1B of FIG. 1C.

FIG. 1C is a partial sectional view along line 1C—1C of FIG. 1A.

FIG. 7 is the other side view of the cam of FIG. 5.

FIG. 8 is a rear elevation view of the breech just before the firing of an ammunition.

FIG. 9 is a partial sectional view of a pressure-release system embodied in the open breech weapon.

FIG. 10 is a cross sectional view of an ammunition, with front views of (A, B, C) of various types of ammunition.

FIG. 13A is a rear elevation view of the breech for illustrating a feeder device especially designed for cylindrical ammunition.

FIG. 13B is a partial sectional view along line 13B—13B of FIG. 13A.

DETAILED DESCRIPTION OF THE PREFERRED EMBODIMENTS

Figures 2A, 2B, 2C, 2D, 6:
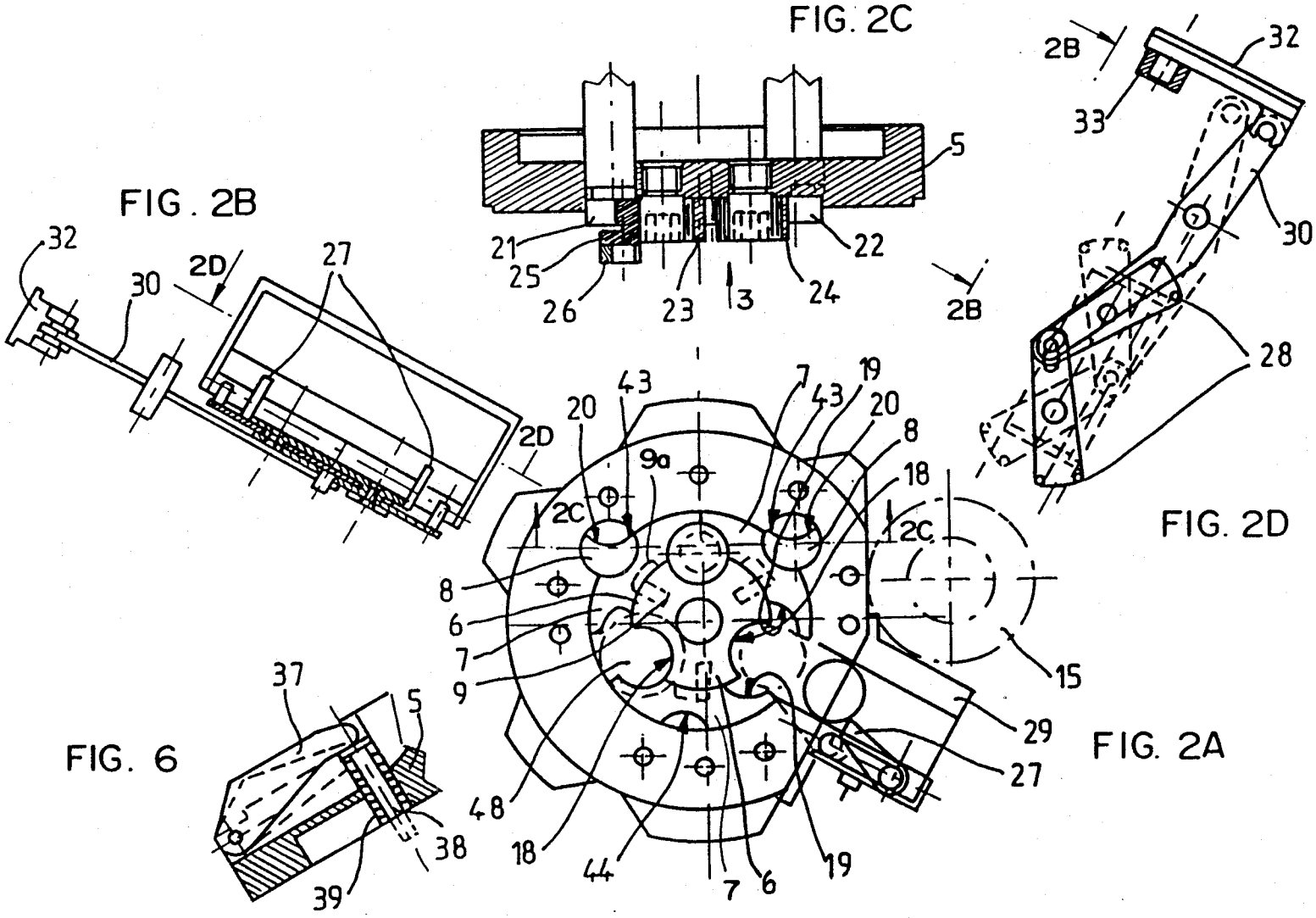
FIG. 2A is a rear elevation view of the breech in a firing position.
FIG. 2B is a partial sectional view along line 2B—2B of FIG. 2D.
FIG. 2C is a partial sectional view along line 2C—2C of FIG. 2A.
FIG. 2D is an external view along line 2D—2D of FIG. 2B.
FIG. 6 is a partial sectional view of an ejection device embodied in the open breech weapon.

In FIGS. 1 to 17, the same reference numerals have been used to designate the same components. The weapon in accordance with the description which follows can fire ammunition of different shapes by means of a basic design requiring only few modifications to change from one ammunition shape to another.

In the version intended to fire cylindrical ammunition and such as is shown in FIGS. 1A–C, the weapon comprises a barrel locked by dovetails 2 into a casing 3 and locked against rotation by the lock 4. The casing 3, closed to the rear by a cover 5, effects rotary guidance of the rotor 6, components 7 and locks (FIG. 2A). The components 7 rotate with the rotor 6. The components 7 also oscillate with respect to rotor 6, such oscillation being limited by the pins 9 received by slots 9*a*, whereby pins 9 are fixed to rotor 6.

At the rear, a cover 10 encloses the control cam 11 which is fixed to cams 12 and 13, which drive the roller mounting 14 in intermittent rotary displacement.

The weapon mechanism is driven by a motor 15, the output shaft of which meshes with the toothed wheel 16 machined at the edge of the control cam 11.

The rounds are detonated by means of a firing pin 17, the operation of which will be described later on.

On the rotor 6, three cavities 18 are machined at 120° (FIG. 2A), and, in conjunction with the cavities 19 on the components 7, they form the breech.

Figure 3:
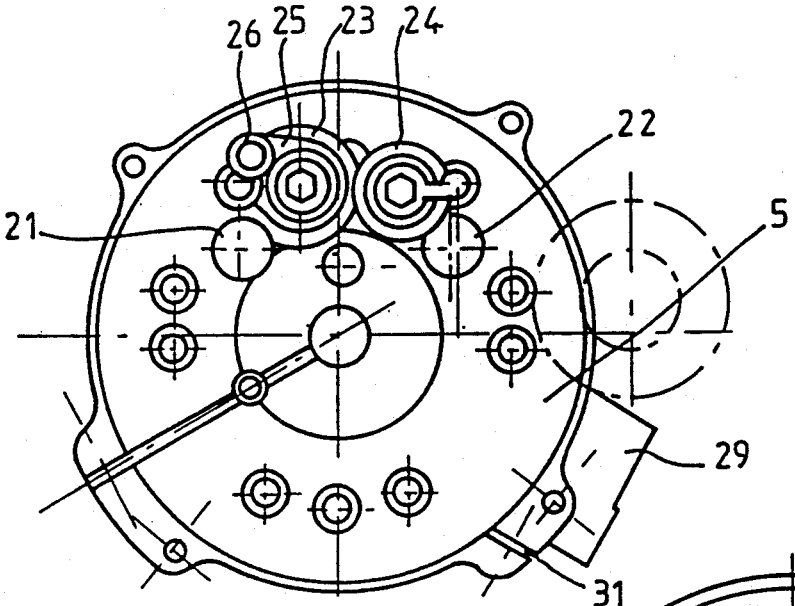
FIG. 3 is an external view in the direction of the arrow 3 of FIG. 2C.

The locks 8 consist of a cylinder on which a cavity 20 is machined. Cavity 20 depending on the orientation of the locks, enables movement of the components to occur or locks them. The rear end of each of these locks 8 comprises the pinions 21 and 22, which mesh respectively with the pinions 23 and 24, the axes of rotation of which are fixed to the cover 5. The pinion 23 also has a crank arm 25 ending in a roller 26 (FIG. 3).

Figure 4:
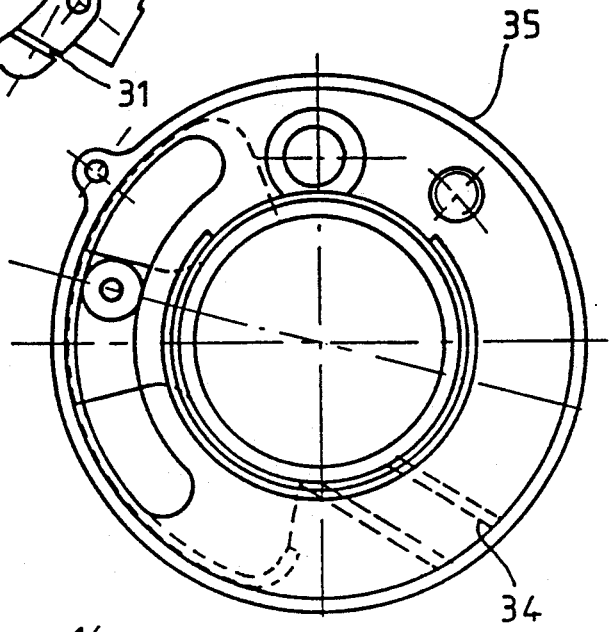
FIG. 4 is a detail of an ammunition feeder device embodied in the open breech weapon.
Figure 5:
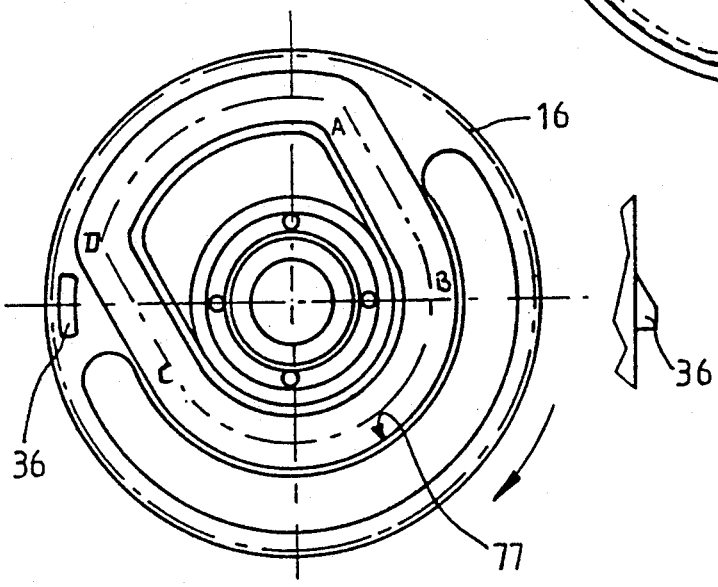
FIG. 5 is a first side view of a cam of control means embodied in the open breech weapon.

The ammunition is fed by means of a ratchet feeder 27 (FIG. 8). These are actuated in a reciprocating displacement by the levers 28 which are jointed on the box 29, themselves controlled by a lever 30 jointed in an eye-joint link 31 in the cover 5 (FIG. 3). The lever 30 is driven by the shuttle 32 fitted with a roller 33 which is guided by a runner 34 (FIG. 4) machined into the partition 35 of the cover 10. The control cam 11 has a groove A-B-C-D machined into its front (FIG. 5). On its rear, a circular groove 40 is machined. This groove is eccentric with respect to the axis of rotation (FIG. 7). The roller 33 runs in the groove 40. A projection 36 in the front hits against a lever 37 (FIG. 6) jointed on the cover 5. The impact against the lever 37 is transmitted to an ejector 38 connected to a spring 39.

Thus the motor 15, which might for example be electric, hydraulic or pneumatic, drives the control cam 11 in rotary motion. The cam completes one revolution per firing cycle.

While the roller 26 runs around the groove on the cam 11 (FIG. 5) from B-A-D-C, i.e. ½ rotation, the ratchets 27, controlled by the levers 28 and 30 in conjunction with the groove 40, feed a round into the housing formed between the rotor 6 and the components 7 (FIG. 2A). When the roller 26 runs from C-B in the groove, i.e. ½ revolution of the cam 11, the cams 12 and 13 rotate the roller-carrier 14 by 120°. This rotation is transmitted to the rotor 6 through the pinions 41 and 42 (FIG. 1), the round is fed to a position opposite the barrel 1 ready to be fired. During this same phase, the feeder ratches 27 have come to a position behind the next round to be fired. FIG. 8 shows the position of the parts (rotor 6, components 7 and locks 8) before closure and locking of the breech.

The control cam 11 rotates in the direction of the arrow as shown in FIG. 5, and the roller 26, which is running from B-A in the groove, drives the pinions 23 and 24 to rotate and consequently the locks 8 rotate by the intermediate action of the pinions 21 and 22. The edge 43 of the locks 8 exerts pressure against the external cavity 44 on components 7, thus causing them to be displaced as indicated by the arrows in FIG. 8. At the end of lock rotation (locks 8) the breech is completely closed and locked as shown in FIG. 2, thus limiting shell expansion after firing.

While the roller 26 runs along A-D of the groove, the pinion 23 stays motionless, which keeps the breech locked during the shot. When the roller 26 is in the D-C section of the groove, the breech unlocks itself in compliance with a process converse to that of locking.

The travel C-B in the groove corresponds to the 120° rotation of the rotor 6 and the components 7.

The hub of the control cam 11 is machined with a groove 45 in which a nipple 46 of the firing pin 17 runs. While the roller 26 runs from D-C-B in the groove of the cam 11, as a result of the nipple 46, the groove 45 actuates compression of the spring 47 of the firing pin 17. When the roller 26 reaches point A in the groove of cam 11, the nipple 46 is freed through the groove 45 under pressure from the spring 47, the firing pin 17 strikes the detonator of the round.

After the round has been fired, the rotation of the rotor/components assembly feeds the empty shell to a point opposite the ejector 38. At this instant, the projection 36 in the cam 11 hits the lever 37, which transmits the impact to the ejector 38, which in turn propels the empty shell towards the front of the weapon, through the aperture 48 (FIG. 2A) machined in casing 3.

A pressure-release system effecting firing stoppage and weapon immobilisation comprises (FIG. 9) a key 49 pushed by a spring 50. The said key slots into the seating 51 of the cam 11 (FIG. 7) and thus effects firing stoppage. The key 49 is mounted in a mounting 52, which pivots in the partition 35 (FIG. 4). A shock-absorber spring, which is not shown in the drawing, seated in the space 53 (FIG. 1) is compressed between the projection of the mounting 52 and the fixed stop 54 (FIG. 4). In this way, impact from sudden stoppage of the cam 11 by the key 49 is absorbed. Removal of the key 49 is effected by an electro- magnet which also is not shown in the drawing.

As firing stoppage occurs when the cam 11 has rotated by an angle of 30° after the firing point A, this same mechanism can also serve to stop the weapon in the event of long burst firing, which presents no problem given that the rotation angle of the cam 11 during which the breech remains locked is 90° and there remain 60° to absorb the impact caused by sudden stoppage of the weapon.

By way of an advantage, non-initiation of the round is detected in a manner known to the art, either by weapon recoil or by tapped gas actuating the key 49.

This type of weapon enables telescoped, shelled ammunition to be fired, and a suggested design for this is shown in FIG. 10. The cross-section of these types of ammunition may have shapes A, B or C.

The mechanism described above only permits of the firing of cylindrical ammunition.

Figure 11:
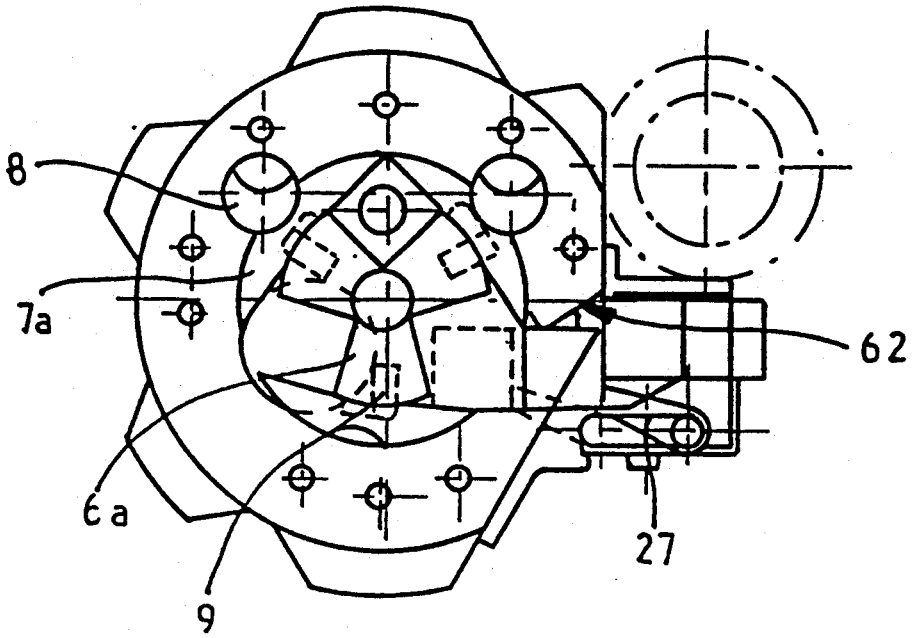
FIG. 11 is a rear elevation view of the breech in a firing position in accordance with a second embodiment of the invention for firing square-section ammunition.
Figure 12:
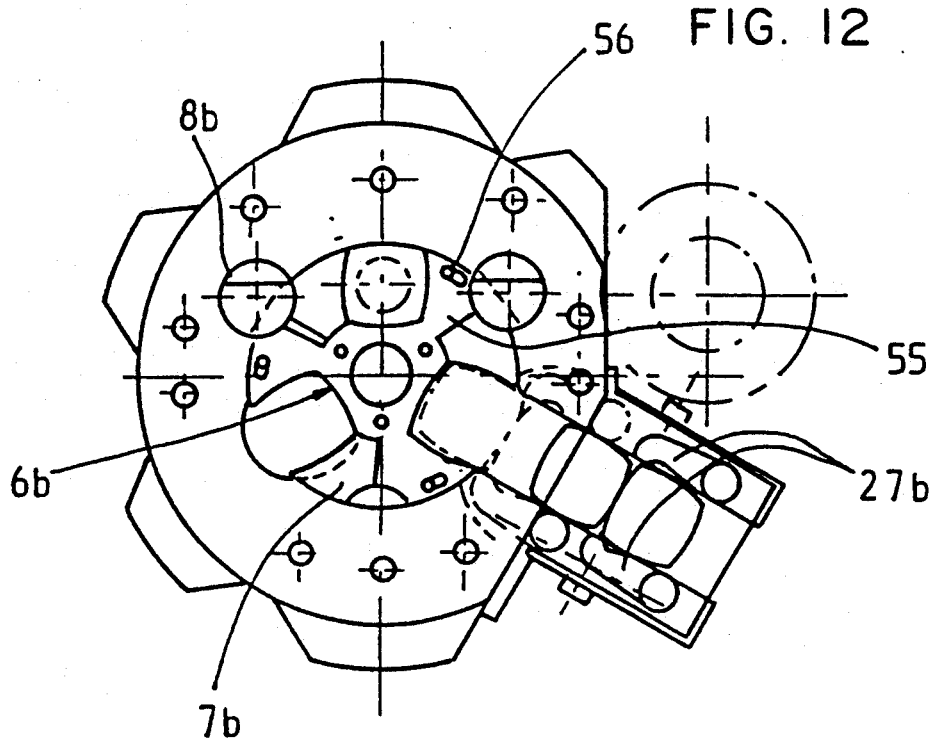
FIG. 12 is a rear elevation view of the breech in accordance with a third embodiment of the invention for firing square curved section ammunition.

FIG. 11 shows a mechanism operating on the same principle but enabling square-section ammunition to be fired, as type B in FIG. 10.

Here again there is a rotor **6*a*, components 7*a*, locks 8, pins 9 and the ratchet feeder 27. The kinematics of the system are identical with that described above. By way of an advantage, it has a specificity consisting in that there is an incline 62 in the feed cavity which enables the ammunition to be separated and which facilitates their being grasped by the ratchets 27**.

FIG. 2 shows a mechanism enabling prismatic ammunition of square curved section to be fired, as of type C in FIG. 10. Here again there is a rotor **6*b*, components 7*b*, locks 8*b*, pins 9 and the ratchet feeder 27*b*. The rotor 6*b* differs significantly from the rotor 6 in that it has at each of its ends a thin plate 55, which is intended to drive the round from the feeder location to the firing location. The plate 55, by means of the lugs 56, drives the components 7*b* in rotary motion. In this version, the movement of the components 7*b* with respect to the rotor 6*b* is slight. Feed is effected by means of a mechanism identical with that of the preceding versions, except that it has a double set of ratchets 27*b***.

FIG. 13 shows a feeder mechanism especially designed for cylindrical ammunition. In this example, the ratchet feeder is replaced by a star 57 enclosed in a casing 58. This star 57 is driven to rotate uniformly and travels ⅓ of a rotation per cycle. It is driven by the motor 15, which has in this example an output pinion 59 meshing with the double pinion 60, which drives a pinion 61 fixed to the feeder star 57. Such a mechanism enables the control cam 11 to be simplified by dispensing with the requirement for the groove 40.

As well as the advantages of open breech weapons known already to the art, the following ones can be had from this weapon system:

- the breech is always surrounded by moving components (rotor 6, components 7) which are locked around the round during firing and which subsequently withdraw to free the empty shell to be ejected. This arrangement eliminates friction problems caused by shell swelling after firing;
- a single cam 11, directly bearing on the energy source, controls the various components and operating sequences. As a result, the system is very reliable and safe in operation in that untimely stoppage of one of the components has the effect of automatic and complete weapon stoppage;
- the double cam system (cams 12 and 13, Ferguson system), which controls the intermittent rotation of the rotor 6, guarantees precise positioning of the rotor at the time of locking of the components 7;
- except for the feeder mechanism, which only has low inertia parts subject to alternating motion of low amplitude, all the components are driven in rotary motion thus endowing the weapon with good operating action and permitting high firing rates. Thus, it can reasonably be hoped that there will be reduced wear and thus an improved life-span with respect to a classical weapon;
- the basic version can very easily be modified in order to fire ammunition of different shapes, particularly squaresection rounds, thus providing the best compromise of volume/useful weight;
- the possibility of electric detonation by a rotating contactor connected to the control cam 11 and effecting current transfer from the firing pin to the detonator at the moment of passage of the roller 26 over point A of the groove A-B-C-D on said cam 11;
- as shown in FIG. 10, the possibility of firing ammunition which is sealed by design, said ammunition being solidly held in the breech during firing;
- locking components with entirely positive control, providing advanced operational safety;
- a compact weapon which easily fits to any carrier vehicle, whatever the ammunition to be fired.

For the reasons given above concerning volume/useful weight ratio, it is advantageous to fire prismatic ammunition of square section.

Starting out from the basic design, a specific weapon could be developed which has a simplified mechanism, particularly where the rotor 6 is concerned.

Figure 14:
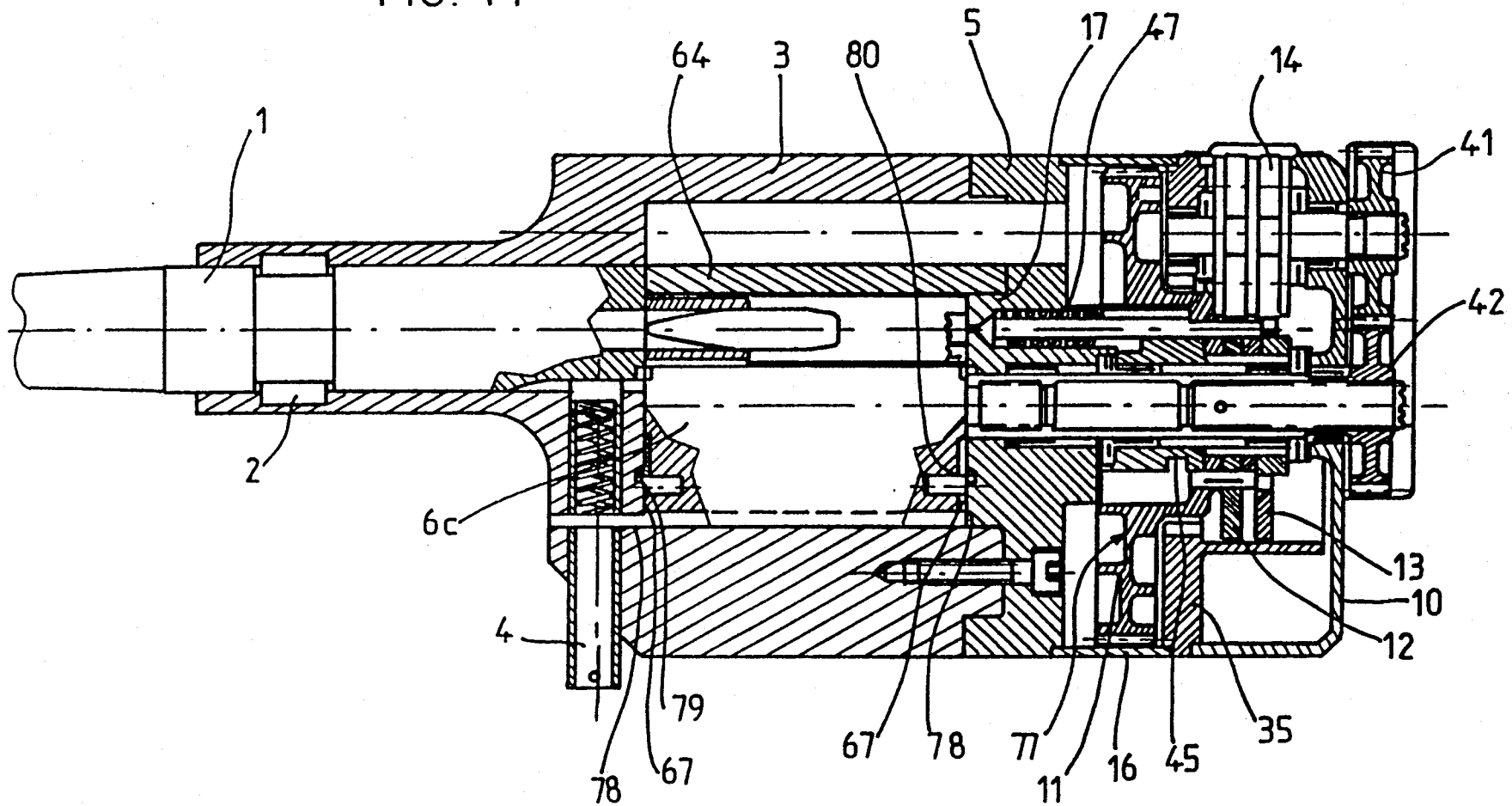
FIG. 14 is a partial sectional view of open breech weapon in accordance with a fourth embodiment of the invention.
Figure 15:
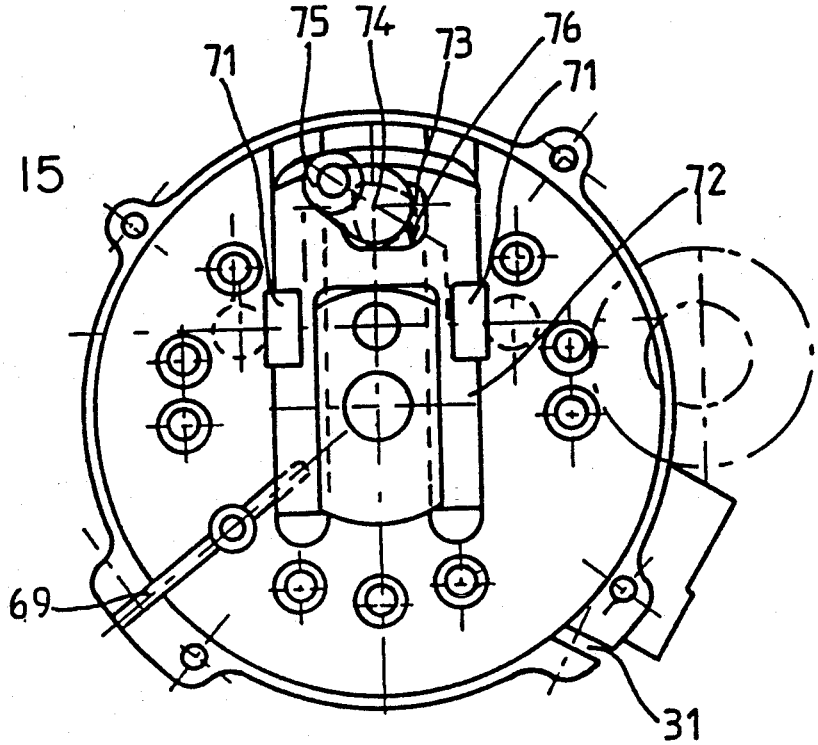
FIG. 15 is an external view in the direction of the arrow 15 of FIG. 16E.

FIG. 14 shows a weapon on which, again, there is the barrel 1, locked by dovetails 2 into the casing 3 and immobilised against rotary motion by the lock 4. The casing 3, closed to the rear by a cover 5, guides the rotor 6c in rotary motion, as well as the two locks 63, a closure valve 64 and its locking cylinder 65.

At the rear, the casing 10 encloses the control cam 11, which is fixed to the cams 12 and 13 causing the roller-carrier 14 to rotate intermittently. One can also see a motor 15, the output shaft of which bears a pinion which meshes into the toothed wheel 16 machined at the edge of the control cam 11. The rotor 6c has three grooves 66 at 120°, which act as the breech. At each end of these breeches, extractors 67 are located. A lever 68, jointed in an eye-joint link 69 on the cover 5, bears on the ejector 38, which is connected to its spring 39. The locks 63 comprise a cylinder on which a flat is machined. At the end of these locks, there is a pinion 70, which meshes with the racks 71 (FIG. 15) machined on a fork 72.

The locking cylinder 65 has a flat opposite the closure valve 64. Its rear end comprises a cam 73 and a crank 74 bearing a roller 75. The cam 73 rotates inside an aperture 76 in the fork 72.

The feeder, firing and ejection mechanisms are strictly the same as those of the basic version and are also controlled by the cam 11. Consequently, the previous description can be referred to.

During operation, the motor 15 drives the cam 11 which completes one revolution per firing cycle. While the roller 75 runs along the section B-A-D-C of the groove 77 on the control cam 11, i.e. ½ revolution, the ratchets 27 feed a round into the groove 66 of the rotor 6c.

During the following ½ revolution, the roller 75 runs along the section C-B of the groove 77, cams 12 and 13 rotate the roller- carrier 14 by 120°. This rotary movement is transmitted to the rotor 6c through pinions 41 and 42; the round is fed to a position opposite the barrel 1 to be fired. During this period, the ratchets 27 have reached a position behind the next round to be fired.

The firing process repeats the same steps and operates in the same way as in the basic version.

During rotation of the cam 11, the roller 75 goes from B to A in the groove 77, which results in a rotation of the locking cylinder 65 and of the cam 73, which in turn actuates the translation of the fork 72, thus of the racks 71 and consequently rotation of the locks 63. At this moment, the breech is locked by the cylinder 65 bearing on the closure valve 64 (FIG. 16); the rotor 6c is immobilised by the locks 63. The cam 11 continues its rotation and the roller 75 moves from A to D: during this phase, the breech does not change status, the roller 75 staying motionless. Unlocking is effected when the roller 75 moves from D to C, as a result of a process converse to that of locking; the roller 75 adopting a position at C such that no force is exerted on it until it returns to B. Movement from C to B corresponds to the 120° rotation of the rotor 6c.

During the rotation of the rotor 6c, the tabs 78 on extractors 67 follow the grooves 79 and 80 machined in the casing 3 and the cover 5 respectively and thus the geometry is designed in such a way that the extractors 67 swivel and remove the empty shell from the groove 66. Then the projection 36 on cam 11 hits against the lever 68, which transmits the impact to the ejector 38. The empty shell is removed through the aperture 81 machined in the casing 3.

The pressure-release and "long burst firing" systems are identical with those used in the original weapon.

Figure 17:
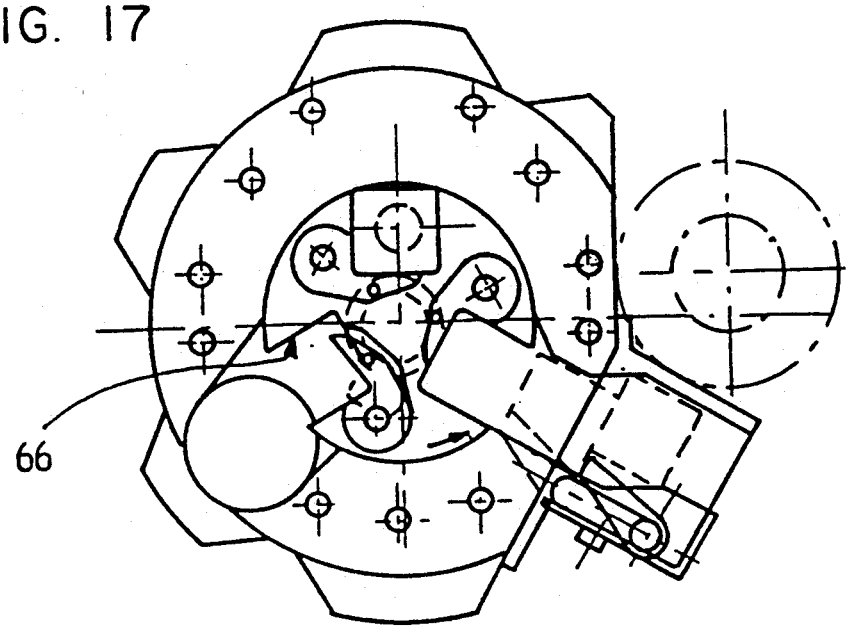
FIG. 17 is a simplified rear elevation view of FIG. 16A.
Figures 16A, 16B, 16C, 16D, 16E, 16F:
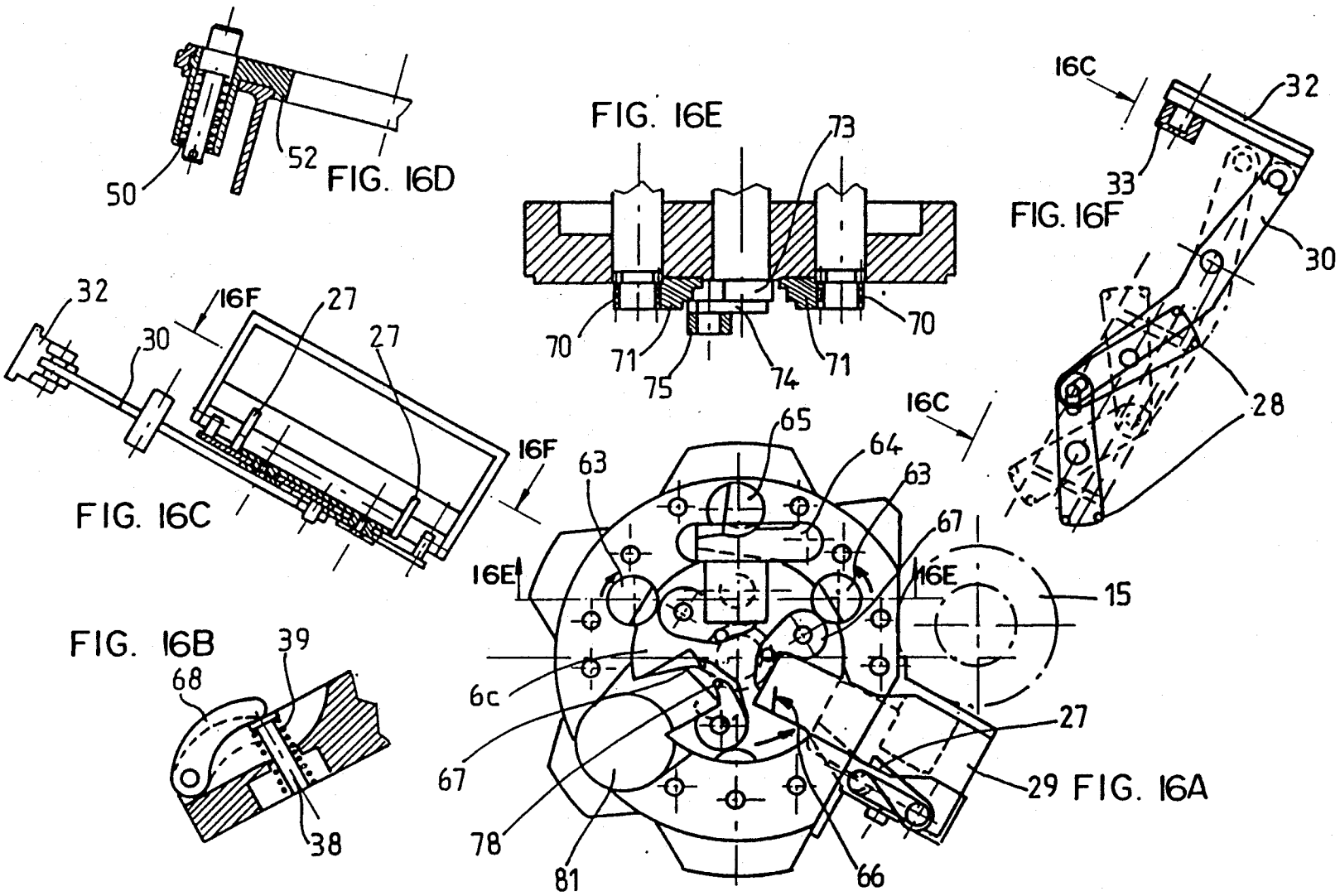
FIG. 16A is a rear elevation view of the breech of FIG. 14.
FIG. 16B is a partial sectional view of an ejection device embodied in the open breech weapon of FIG. 14.
FIG. 16C is a partial sectional view along line 16C—16C of FIG. 16F.
FIG. 16D is a partial sectional view of a pressure-relates system embodied in the open breech weapon of FIG. 14.
FIG. 16E is a partial sectional view along line 16E—16E of FIG. 16A.
FIG. 16F is an external view along line 16F—16F of FIG. 16C.

If the firing pressure and thus shell deformations are low enough, a simplified version such as is shown in FIG. 17 could be envisaged. In this case, the locks 63 and 65 could be dispensed with along with their controller components, including the groove 77 in the control cam 11.

An intermediate solution may even be envisaged in which the closure valve 64 and its locking cylinder 65 would be dispensed with, the rotor 6c being made rigid by the locks 63, which would conserve ease of shell ejection.

The invention concerns particularly the manufacture of rapid fire weapons, for example small or medium calibre weapons.

The invention mainly concerns the execution of machine guns with rapid firing rates, particularly those which are airborne.

We claim:

1. Open breech weapon comprising:

a barrel having a rear end locked to a casing;

a rotor rotatably mounted in said casing about an axis parallel to said barrel, said rotor comprising at least one peripheral cavity which extends parallel to the rotation axis of the rotor;

first control means for rotatably driving said rotor, whereby said peripheral cavity of the rotor is rotated, during one rotation of the rotor, to a feeding position to receive an ammunition round from a feeding device, to firing position at said barrel to fire the ammunition round by action of a firing pin, and to an ejecting position to eject an empty shell by an ejection device after firing of the ammunition round;

at least two arcuate components supported by said rotor such that said components are rotated with said rotor, each component being hinged to said rotor to have an oscillating motion with respect to said rotor, and being provided with a longitudinal cavity which is parallel to said peripheral cavity of said rotor, whereby each longitudinal cavity of two adjacent arcuate components and the peripheral cavity of the rotor define a breech at said firing position; and locking-unlocking means for moving said two adjacent arcuate components together to define a closed position when the peripheral cavity of said rotor is in said firing position, said peripheral cavity of said rotor and the longitudinal cavities of said two adjacent arcuate components forming said breech which is of the same shape as the ammunition round.

2. The open breech weapon of claim 1, wherein two locking-unlocking means are located on opposite sides of the firing position, each locking-unlocking means comprising a cylinder parallel to the rotor and provided with a longitudinal groove delimited by two edges, and wherein each arcuate component comprises a complementary groove delimited by two edges such that when said cylinders are actuated in rotation by second control means, one of the edges of each groove of each cylinder comes into contact with one of the edges of each complementary groove of each arcuate component thereby moving each arcuate component with respect to the rotor in said closed position.

3. The open breech weapon of claim 2, wherein said at least one peripheral cavity of said rotor is defined by three peripheral cavities, and wherein said at least two arcuate components is defined by three arcuate components, wherein each of said three arcuate components is disposed between adjacent peripheral cavities of said rotor.

4. The open breech weapon of claim 1, wherein the rotor and the locking-unlocking means are controlled by a cam driven by a motor.

5. The open breech weapon of claim 4, wherein the cam comprises a guide-groove, wherein portions of said guide-groove prevent unlocking of the breech while firing the ammunition round.

6. The open breech weapon of claim 1, wherein the breech is circular is cross-section.

7. The open breech weapon of claim 1, wherein the breech is substantially square in cross-section.

8. The open breech weapon of claim 1, wherein the ammunition round is a telescoped ammunition round.

* * * * *